United States Patent [19]

Montgomery

[11] 4,124,134

[45] Nov. 7, 1978

[54] CHILD-RESISTANT PACKAGE FOR LIQUIDS

[75] Inventor: Gary V. Montgomery, Evansville, Ind.

[73] Assignee: Sunbeam Plastics Corporation, Evansville, Ind.

[21] Appl. No.: 881,130

[22] Filed: Feb. 24, 1978

Related U.S. Application Data

[63] Continuation-in-part of Ser. No. 823,433, Aug. 10, 1977, abandoned.

[51] Int. Cl.[2] ..... B65D 55/02; B65D 85/56; A61J 1/00

[52] U.S. Cl. ..... 215/224; 215/215; 215/321

[58] Field of Search ..... 215/206, 223, 224, 350, 215/215, 317, 321; 220/306

[56] References Cited

U.S. PATENT DOCUMENTS

| | | | |
|---|---|---|---|
| 3,980,194 | 9/1976 | Costa | 215/224 X |
| 3,986,626 | 10/1976 | Montgomery | 215/224 X |

*Primary Examiner*—George T. Hall
*Attorney, Agent, or Firm*—Henry K. Leonard

[57] ABSTRACT

A child-resistant package for liquids consisting of a container and a cap therefor. The container has a narrow tubular neck and a protruding concentric spout of diameter less than that of the neck so there is a shoulder at the base of the spout connnecting the spout to the container neck. The spout has an annular lip and a circular rib on its exterior that is located between the shoulder and the end of the spout. The rib has conical upper and lower surfaces which meet at a circular apex. The lower conical surface defines with the neck an angle which is greater than the angle defined between the upper conical surface and the neck. The package includes a cup-shaped cap which fits over the end of the spout. The cap has a disc-like top, an annular skirt and inwardly extending tooth-like elements on the inner side of the skirt which have a minimum diameter of such size and are spaced from the top a distance such that the elements on the cap snap in beneath the apex of the neck rib when the cap is pressed onto the spout. In the disclosed embodiment, there is a compressible liner in the cap which is squeezed tightly against and compressed by the spout lip. The margin of the cap skirt is spaced slightly away from the container shoulder when the cap is in place. The retaining force exercised by the engaged rib and elements is such that the cap cannot be manually removed by a child of tender years.

There are tooth-like elements on the underside of the spout rib which interengage with the elements on the cap skirt for preventing relative rotation of the cap and container.

10 Claims, 5 Drawing Figures

CHILD-RESISTANT PACKAGE FOR LIQUIDS

BACKGROUND OF THE INVENTION

Many child-resistant packages for liquid materials which would be harmful is ingested or encountered by persons have been suggested and utilized in the past. The usual objective of such packages is to provide a liquid container and a cap for that container so designed as to be extremely difficult, if not impossible, of removal by a child of tender years, say, six or younger. At the same time, of course, such child-resistant packages must be so designed as to permit them to be opened by older children or adults.

Many of the previous child-resistant combinations of containers and caps have utilized caps consisting of more than one piece so that their cost has been excessively high by reason of the necessity for the utilization of more than one production mold and the requirement for assembly steps. Other child-resistant combinations utilize caps and containers which have cooperative child-resistant means of such nature as to require complicated and expensive molds for either the cap or the container neck or both. Again, this increases the cost of such devices.

In some cases the configuration of the neck or spout of a container which is to be utilized with a cap to provide a child-resistant package is such that the container cannot be utilized with anything other than the specific cap for which it is designed.

It is therefore the principal object of the instant invention to provide a child-resistant package for dangerous liquids consisting of a container and a cap which are relatively simple, the cap being one piece only, and which comprises, when desired, child-resistant features or, if not desired, the container can be utilized with a standard cap which does not comprise child-resistant features.

In addition, a combination container and cap according to the invention provides inter-engaging means which both insure a liquid tight seal and which substantially prevent relative rotation of the cap and the container when the cap is on the container.

DESCRIPTION OF PREFERRED EMBODIMENT

Figure 1:
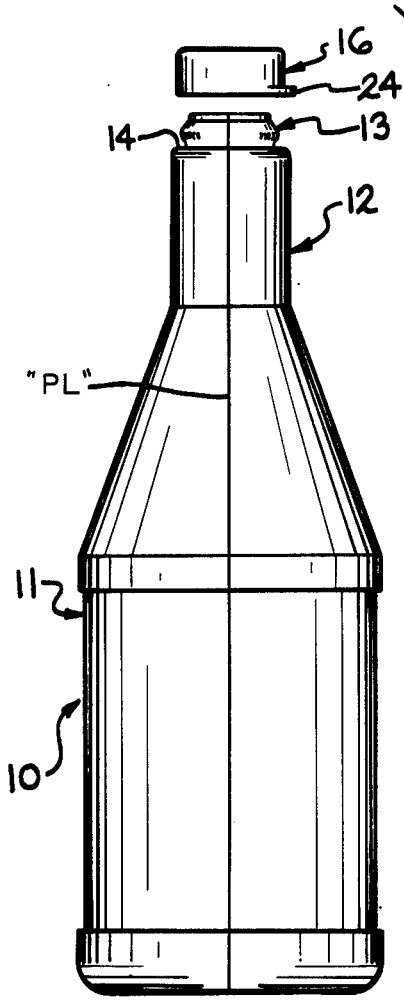
FIG. 1 is a view in side elevation of a package embodying the invention illustrating both the container and a cap therefor in spaced relationship.

A package embodying the invention includes a container 10 which comprises a hollow body 11, a neck 12 of lesser diameter and a spout 13 also, preferably, of a maximum diameter less than that of the neck 12. An annular shoulder 14 is thus located at the base of the spout 13. The spout 13 terminates in an annular planar lip 15.

The container 10 is illustrated as it would appear if it were molded from a resinous material in accordance with conventional molding techniques so that certain of the elements thereof can be given relatively sharp corners and precise dimensions and, preferably, it should be so fabricated. However, as readily can be appreciated by those informed in the art, the container 10 may be molded from glass in which case the only difference from the configuration illustrated in the drawings would lie in the particular and precise shapes of the elements on the spout 13 and on a cap 16 with which the container is closed.

Figure 5:
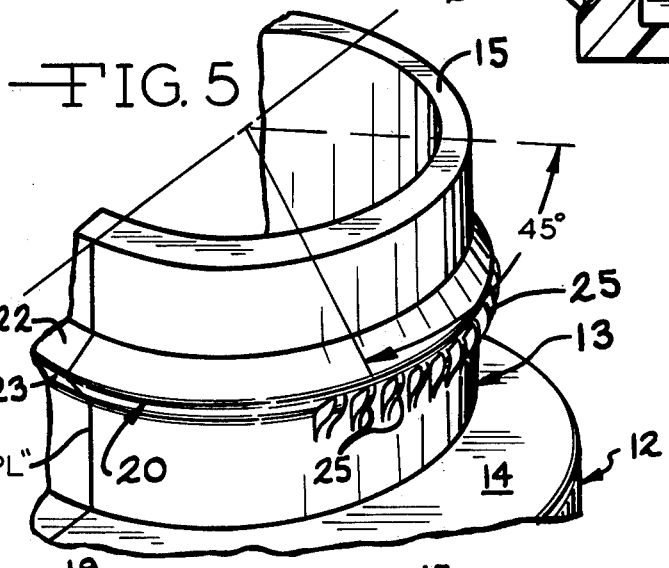
FIG. 5 is a fragmentary view in perspective showing the shape and location of elements on the neck of a container according to the invention.
Figure 3:
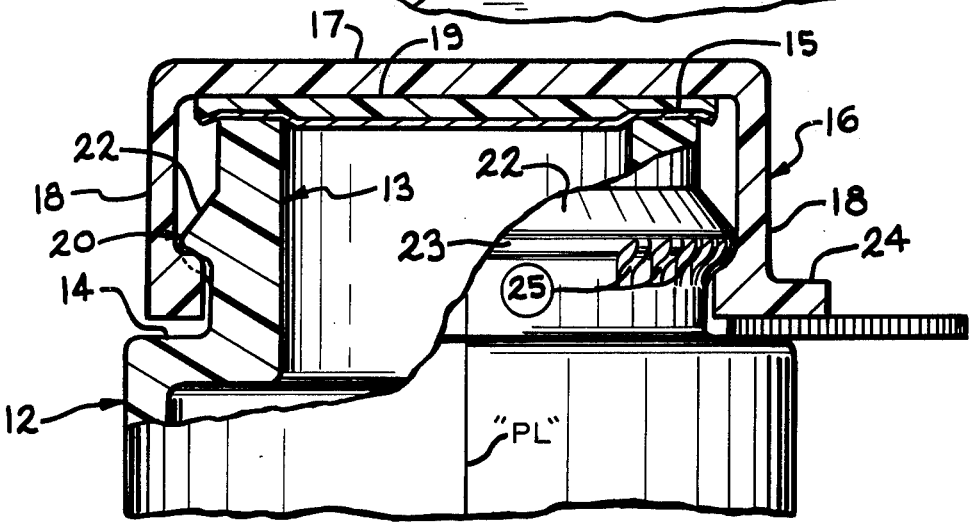
FIG. 3 is a greatly enlarged, fragmentary view, partly in elevation and partly in section, the sectional portion being taken along the line 3—3 of FIG. 2, illustrating the cooperating means on a cap and a container neck according to the invention.

Whether the container 10 is molded from plastic material or from glass the container has mold parting lines indicated in FIGS. 1, 3 and 5 by the initial letters "PL". These parting lines lie in a vertical radial plane, as is most easily perceiveable in FIG. 5.

The cap 16 has a disc-like top 17 and an annular skirt 18 and preferably is provided with an interior sealing washer 19 (FIG. 3) that is thrust tightly into engagement with the container lip 15 when the cap 16 is in sealing position on the container neck 12.

Figure 4:
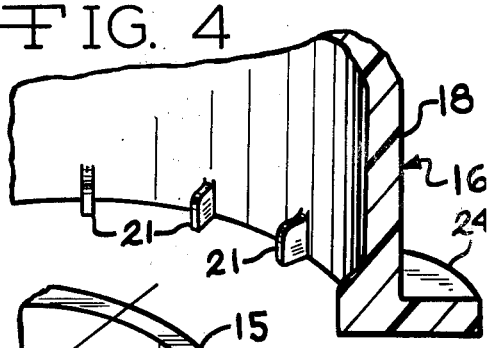
FIG. 4 is a fragmentary view in perspective showing the elements on the inner side of a cap skirt according to the invention.

According to the invention, both the cap 16 and the container spout 13 have cooperating means by which the cap 16 is held downwardly in sealing position with sufficient force so as to create a substantially child-resistant package. These means consist of an annular rib 20 on the container spout 13 and a series of tooth-like elements 21 (see FIG. 4) on the inner side of the cap skirt 16. The spout rib 20 has an upper conical surface 22 and a lower conical surface 23. Preferably the angle between the upper conical surface 22 and the cylindrical surface of the upper portion of the spout 13 is less than the angle between the lower conical surface 23 and the lower portion of the exterior surface of the spout 13.

The elements 21 on the interior surface of the cap skirt 18 have a profile configuration such that when the cap 16 is forced downwardly into sealing position (FIG. 3) the upper inner corners of the cap elements 21 engage the lower conical surface 23 of the spout rib 20 thus resulting in the cap 16 being continuously biased downwardly and thereby continuing pressure against the sealing washer 19 by the container lip 15. This is most easily perceived by reference to the left hand portion of FIG. 3.

It will be appreciated, of course, that in order for the cap 16 to be thus forced downwardly it must be fabricated from one of the stiffly resilient plastic materials so that the margin of the cap skirt 18 can be expanded as the cap 16 is forced downwardly. The reason for the lesser angular relationship of the upper conical surface 22 of the cap rib 20 is to result in requiring less force to be exerted for moving the cap 16 downwardly beyond the spout rib 20 than is required for moving the cap 16 upwardly off of the spout 13. Preferably the relationship between these conical surfaces and the upper inner corners of the cap elements 21 is such that a force of approximately thirty pounds is required for removing the cap 16 from the container 10 whereas substantially less force is required for placing the cap 16 on the container 10.

In order to facilitate removal of the cap 16 from the container 10, the cap 16 has a radially protruding ear 24 at the lower margin of cap skirt 18. The axial lengths of the cap skirt 18 and the container spout 13 are such that when the cap 16 is in sealing position on the container 10 (FIGS. 2 and 3), a space exists between the under surface of the skirt 18 and the lip 24 and the surface of the annular shoulder 14 on the container neck 12. The cap 16 may be removed by an older child or an adult merely by inserting into that space a thin, flat object such as a coin shown in FIGS. 2 and 3 of approximately the size of a United States ten cent piece or, if greater leverage is desired, a United States quarter-dollar. By twisting such a coin, or another object such as the flat end of a screw driver, or the like, the cap 16 may be pried off of the container 10 so that its contents can be poured out.

Figure 2:
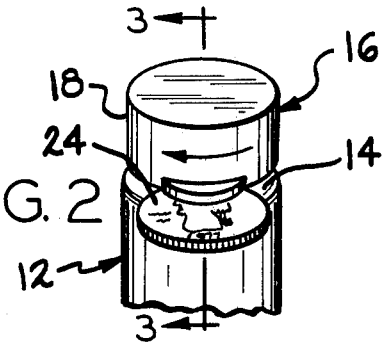
FIG. 2 is a fragmentary view in perspective showing a cap in closed position on the end of a neck of a container according to the invention and illustrating how an object such as a coin may be utilized for removing the cap from the container.

It will be noted by reference to FIG. 2 that an arrow has been drawn adjacent the edge of the coin illustrating how the coin is to be twisted and that a second arrow has been drawn on the outer surface of the cap skirt 18. When the coin is twisted as shown, the edge of the coin engages beneath the under surface of the skirt 18 and the ear 24 and tends to rotate the cap 16 relative to the container 10 since the upper engaging edge of the coin is moving in the direction illustrated. Of course, if the coin were twisted in a clockwise direction rather than in a counterclockwise direction shown in FIG. 2, the cap 16 would tend to be rotated in a direction opposite to that indicated by the arrow on the skirt 18 in FIG. 2.

In order to prevent rotation from taking place when the coin or other flat object is inserted by someone wishing to remove the cap 16 from the container 10, both the cap 16 and the container spout 13 are provided with interengaging means. These interengaging means on the cap 16 are the inwardly protruding, spaced elements 21, best shown in FIG. 4. The cooperating elements on the container spout 13 are two circumferentially extending series of tooth-like elements 25. All of the elements 25 have an outer profile and are so spaced as to provide for the interdigitation between adjacent ones of anyone of the elements 21 on the cap skirt 16. However, it should be noted that, as is best shown in FIGS. 3 and 5, the elements 25 are located in two circumferentially extending spaced groups. Each of the groups of elements, for example the group shown in FIG. 5, extends circumferentially not more than about 22½° on either side of a diametric line which is perpendicular to the radial plane of the parting lines. In other words, the circumferential extent of each of the groups of spout elements 25 should not be more than about 45° and this extent is indicated in FIG. 5 by the construction lines and the arcuate arrow bearing the symbol "45°". While the provision of two such groups of elements 25 is desirable and is illustrated in the drawings, insofar as their function is concerned, it possibly could be achieved by the use of only one such group. When two such groups are provided on the container neck 13 as is illustrated, then, of course, these two groups should be diametrically opposed to each other so that each of them lies within the not more than 45 degree angle span centered on the diameter which is normal to the plane of the parting lines. By so locating these radially outwardly protruding tooth-like elements 25, the half-molds may be separated along this same perpendicular diameter without problems due to the build-in degree of flexibility of the material from which the container 10 is fabricated if plastic.

It must be kept in mind however, that if the container 10 is to be fabricated from glass, then each series of the interengaging elements 25 on the container neck 13 cannot have as great a circumferential extent and it may be necessary to provide only one or two such elements located at the diametric line referred to. In such a case, the elements 21 on the interior of the cap skirt 18 would have to be more numerous so that no matter what the angular relationship between the cap 16 and the container spout 13 might be at the time the cap is thrust downwardly into sealing position on the container 10, the elements 21 of the cap would interengage with the elements 25 on the container spout 13.

Having described my invention, I claim,

1. A child-resistant package for liquids, said package consisting of (a) a hollow container having
  (1) a tubular neck
  (2) a protruding spout concentric with and of lesser diameter than said neck and having an annular lip,
  (3) a circular rib on the exterior of said spout, said rib having upper and lower conical surfaces which meet at a circular apex spaced between said shoulder and said lip, and (b) a cap having
  (1) a disc-like top,
  (2) an annular skirt,
  (3) a circular sealing element in said cap that cooperates with said spout for closing said spout when said cap is in place thereon, and
  (4) an uninterrupted, annular inwardly extending means on the inner side of said skirt having a minimum diameter less than the diameter of the apex of said spout rib and being spaced from said top a distance such that when said cap is pressed on said spout and said means moved downwardly beyond said circular apex, said cap is urged downwardly by engagement of said means with said lower conical surface.

2. A child-resistant package for liquids, said package consisting of (a) a hollow container having
  (1) a tubular neck
  (2) a protruding spout concentric with and of lesser diameter than said neck, said spout having an annular lip,
  (3) a circular rib on the exterior of said spout, said rib having upper and lower conical surfaces which meet at a circular apex spaced between said shoulder and said lip, and (b) a cap having
  (1) a disc-like top,
  (2) an annular skirt, and
  (3) inwardly extending means on the inner side of said skirt having a minimum diameter less than the diameter of the apex of said spout rib and spaced from said top a distance such that when said cap is pressed on said spout and said means moved downwardly beyond said circular apex, said cap is urged downwardly by engagement of said cap means with said lower conical surface, and
  (4) circumferentially extending series of means on said spout rib which are interengageable with said means on said cap skirt for preventing relative rotation of said cap and said container.

3. A child-resistant package according to claim 2 and a circular sealing element in the cap that engages the annular lip of the spout when said cap is in place on said spout.

4. A child-resistant package according to claim 2 in which the cap is molded from a stiffly resilient resinous material so that removal thereof requires force in excess of that exertable by a child of tender years.

5. A child-resistant package according to claim 2 in which the lower conical surface defines an angle relative to the axis of said neck greater than that defined by the upper conical surface relative to such axis.

6. A child-resistant package according to claim 2 in which the angles of the lower conical surface of the spout rib and the contacting surface of the cooperating cap rib are selected to provide a cap retaining force in the range of 30 to 35 pounds.

7. A child-resistant package according to claim 2 and a radially protruding ear on the margin of the cap which overlies and is spaced from the shoulder on the container, whereby a flat object may be inserted therebetween and angularly twisted for lifting said cap off of said container.

8. A child-resistant package according to claim 2 in which the interengaging means consist of opposed tooth-like elements on the lower conical surface of the spout rib and at the lower margin of the cap skirt.

9. A child-resistant package according to claim 8 in which there are a greater number of interengaging elements on the surface of the spout rib than there are on the cap skirt.

10. A child-resistant package according to claim 8 in which the container is circular in horizontal cross-section and has vertical mold parting lines lying in a radial plane and in which there are two circumferentially extending series of elements on said spout rib, each of such series extending circumferentially not more than about twenty-two and a half degrees on each side of a diametric line that extends at right angles to the plane of the parting lines on said container.

* * * * *